United States Patent [19]

Rijnders

[11] 4,236,366

[45] Dec. 2, 1980

[54] PREFABRICATED WALL PANEL

[75] Inventor: Willem Rijnders, Alblasserdam, Netherlands

[73] Assignee: Hunter Douglas International N.V., Netherlands Antilles

[21] Appl. No.: 968,425

[22] Filed: Dec. 11, 1978

[30] Foreign Application Priority Data

Dec. 9, 1977 [DE] Fed. Rep. of Germany ..... 2754814

[51] Int. Cl.[3] ..... E04C 1/30

[52] U.S. Cl. ..... 52/580; 52/595; 52/802

[58] Field of Search ..... 52/580, 578, 593, 595, 52/592, 404, 309.9, 493, 764, 802, 822, 394

[56] References Cited

U.S. PATENT DOCUMENTS 3,372,520 3/1968 Hensel ..... 52/595

FOREIGN PATENT DOCUMENTS 1484291 5/1967 France ..... 52/595

617621 2/1949 United Kingdom ..... 52/593

*Primary Examiner*—James L. Ridgill, Jr.

*Attorney, Agent, or Firm*—Pennie & Edmonds

[57] ABSTRACT

A prefabricated wall panel is disclosed having an insulating core (10) and an outer facing sheet (11) on each side thereof. Along one lateral side edge the facing sheets are spaced from the core material (10) which core material extends as a lateral projection (13) along the one edge. Along the opposite lateral edge of the wall panel a connecting member (15) is provided having a pair of outer laterally extending tongues (14, 14) about each of which is wrapped the adjacent edge of the adjacent facing sheet (11). A pair of inner tongues (19, 19) also extend laterally from the panel and spaced from the outer tongues (14, 14) to which they are connected by narrow webs (18, 18). A broader web (16) extends between the inner tongues. When assembled the free edges (12, 12) of the facing sheets (11, 11) extend into the spaces (21, 21) between the outer (14, 14) and inner (19, 19) outwardly extending tongues and the projection (13) of the core (10) extends into the space between the inner tongues (19, 19).

6 Claims, 2 Drawing Figures

PREFABRICATED WALL PANEL

BACKGROUND

A prefabricated wall panel is known having the core of insulating material sandwiched between two substantially parallel facing sheets. Along one side edge of the wall panel the facing sheets extend beyond the core of material and form free edges. On the opposite side edge there is provided a connecting element having two tongues extending outwardly of the panel toward an adjacent panel with one of the facing sheets extending around each of the two outer tongue portions of the two outer tongues. A connecting segment extends between the two tongues.

As conventionally designed such a wall panel when joined to an adjacent wall panel generally has an interior space having only a very small insulating capability, or none at all at the joint between the connecting member on the edge of one panel and the edge of the core of the complimentary opposite edge of an identical adjacent panel. Accordingly, heat transmission in either direction through the joint is readily possible between the free edges of the facing sheets since the joint has such a poor insulating capability. Frequently, as well, this joint structure lacks strength often to the point of being insufficient for the purpose.

SUMMARY OF THE INVENTION

The disadvantages of the known forms of prefabricated wall panels are overcome by the present invention in which a prefabricated wall panel having a central core of insulating material sandwiched between two substantially parallel facing sheets is provided with a new and novel edge treatment. Along one side edge of the panel both facing sheets are spaced from the panel core by virtue of the panel core in this area being reduced in thickness thus providing a lateral projection of the core. On its opposite edge the wall panel has both facing sheets extending beyond the panel core and folded backward about two outer tongues of a connecting member. Spaced inwardly from the two outer tongues are two inner tongues on the connecting member and a web extends between the two inner tongues. The opposite edges of the panel are complementary in that the spaces between the inner and outer tongues on the connecting member are positioned to receive the portions of the facing sheets on the opposite side which are spaced from the lateral projection of the core. In this way the inner tongues on the connecting member enter into the spaces on the opposite edge between the facing sheets and the lateral projection of the core.

Since the outer and inner tongues and the lateral projection of the core overlap in the direction transverse to the faces of the panel in the area of the joint, wall panels having the joint of the present invention do not provide the free path through the joint for heat transfer which has previously been the case. This considerably enhances the insulating capability of the panel structure. By this structure as well the portion of the facing sheets that is spaced from the lateral projection of the core and the tongue portions of the connecting member may be shortened such that the mechanical strength of the joint is greatly improved.

Advantageously, the web joining the inner tongues is offset in the direction of the ends of the tongues relative to the smaller webs which connect the inner tongues to the outer tongues thus providing for better support in a direction transverse to the faces of the panel particularly when the insulation is of a foam variety and is formed in place during fabrication of the wall.

Preferably, the free edges of the facings and the lateral projection of the core are so dimensioned that when adjacent wall panels are assembled a compensation space remains between these elements and the facing elements of the connecting element. Accordingly, dimensional or positional inaccuracies can readily be compensated for.

The outer surfaces of the outer two tongues may be provided with serrations for engagement with the wrapped around edges of the facing sheets thus providing a better seating between the parts. Further, the outer surfaces of the inner two tongues may be similarly serrated for engagement with the free edges of the facings on the complimentary joint of the adjacent panel again for better seating.

The connecting member also preferably has on either side adjacent to the facing sheets a lip which extends inwardly along the facing sheets and each of these lips bears against the inside of the facing sheet to make a better seal. This seal is particularly advantageous when the core is produced by foaming a plastic foam between the facing sheets.

At the joint a space may be provided between the inner and outer tongues which is greater than that required to receive the free edges of the facing sheets which space may be used for insulating means used for receiving insulating material, sealing material, fastening elements or the like.

BRIEF DESCRIPTION OF THE DRAWINGS

The construction and advantages of the present invention will be readily apparent to those skilled in the art from the following specification and the accompanying drawings in which.

DETAILED DESCRIPTION OF THE PREFERRED EMBODIMENT

Figure 1:
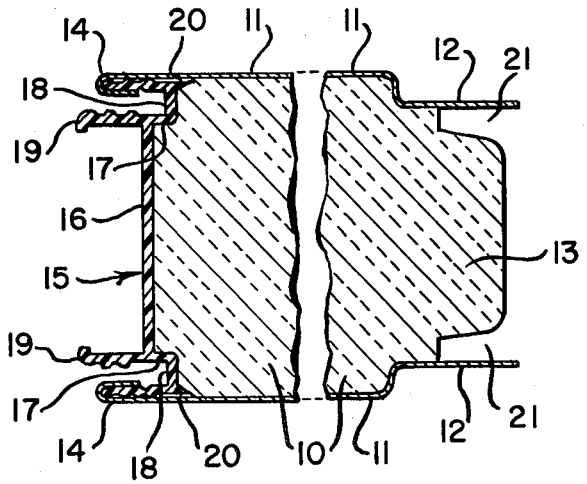
FIG. 1 is a cross-section through a wall panel of the present invention.

The wall panel as shown in FIG. 1 has a core 10 which is preferably an insulating foam material although it may be of any insulating material such as fibrous insulation board, expanded polystyrene beads either loose or formed into a sheet, or the like. The panel is constructed to have two faces on each of which is provided a facing sheet 11 which may be of any suitable material such as wood paneling, paper, plastic, but is preferably of metal. Along one side edge of the panel (the side to the right in FIG. 1) the facing sheets 11 extend free of the core 10. These free edge portions 12 are spaced from a lateral projection 13 of the core 10. Thus there is provided on either side of the panel along its edge shown to the right in FIG. 1 two spaces or grooves 21.

Along the opposite side edge of the panel (to the left in FIG. 1) the edges of the facing sheets 11 are formed around a pair of outer tongues 14 of a connecting member 15. As shown, the connecting member 15 is preferably of plastic although it may be made of any suitable material such as metal including extruded aluminum. The connecting member 15 has the cross-section shown in FIG. 1 and comprises the two outer tongues 14 just mentioned, two inner tongues 19 spaced inwardly from the outer tongues 14 and connected therewith by means of two narrow webs 18. A wider web 16 connects the two inner tongues. As shown in FIG. 1 the narrow outer webs 18 are offset inwardly with respect to the single web 16. Extending between the webs 18 and the web 16 are wall portions 17 which align with the inner tongues 19.

The connecting member 15 also includes inwardly projecting lips 20 which extend inwardly along the facing sheets 11 and actually bear thereagainst in a sealing relationship. Although the drawing shows a slight space between the inner surface of the facing members 11 and the lips 20 it is preferred to so dimension the lips 20 that they actually bear against the inner surface of the facing sheets 11. For clarity in the drawings a slight space is shown. These sealing lips 20 are particularly advantageous when the core material is a plastic foam.

Figure 2:
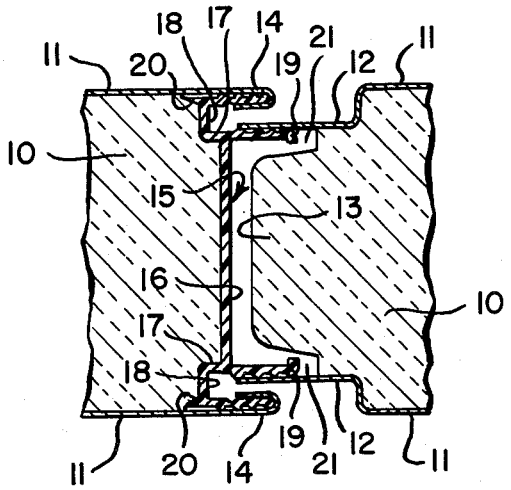
FIG. 2 is a cross-section through a joint between two adjacent wall panels constructed in accordance with the present invention.

As shown in FIG. 2 two adjacent wall panels are joined in the manner shown with the free edges 12 of the facing sheets 11 slid into the space between the inner tongues 19 and the outer tongues 14 and in frictional engagement with the serrations on the outer surface of the inner tongues 19. The inner tongues 19 extend into the space or groove 21 between the facing sheets 11 and the lateral projection 13 of the core 10.

As shown in FIG. 2 the preferred embodiment is so dimensioned as to provide space between the lateral projection 13 of the core 10 and the facing web 16 of the connecting member 15. Similarly, space is also provided between the free edges 12 of the facing sheets 11 and the webs 18 of the connecting member 15. This space may be utilized to compensate for dimensional inaccuracies or position inaccuracies during construction. However, in all cases the dimensioning is such as to insure that the lateral projection 13 of the core 10, which projection 13 is of insulating material, extends into the space between the inner tongues 19. Thus it will be seen that except for the very small space provided for adjustment due to dimensional or positional inaccuracies the joint does have insulating material, notably the insulation material of the lateral projections 13 positioned at the joint to provide insulating capability at this crucial point.

I claim:

1. A prefabricated wall panel comprising a central core of insulating material, two substantially parallel facing sheets on the opposite faces of said core, said core having a lateral projection of a thickness less than said core along one side edge of said panel, each of said facing sheets having free edges along said one edge extending in spaced relationship to said lateral projection to define a pair of grooves along said one edge, each of said grooves being defined on its inner side by said lateral projection and on its outer side by the free edge of one of said facing sheets, the opposite side edge of said panel having a connecting member, said connecting member having a pair of outer laterally projecting tongues, the edges of the adjacent facing sheets being bent around said outer projecting tongues, said connecting member also having a pair of inner laterally projecting tongues spaced inwardly of said outer projecting tongues, the space between and inner projecting tongue and an adjacent outer projecting tongue being sufficient to receive the free edge portions of the sheets of an adjacent identical wall panel, the inner laterally projecting tongues being spaced from one another by a distance to receive the lateral projection of the core of an adjacent identical wall panel, and said inner tongues being positioned and dimensioned to be receivable in the grooves of said adjacent panel.

2. A prefabricated wall panel according to claim 1 wherein said connecting member has a web extending between said inner pair of tongues, a web between each of said inner tongues and its adjacent outer tongue, said first mentioned web being positioned closer to the free ends of the tongues than said second mentioned webs.

3. A prefabricated wall panel according to claim 2 in which the free edge portions of the facing sheets and the lateral projection of the core are of such a dimension that when adjacent wall panels are assembled a compensating space is provided between the adjacent edges of said wall panels.

4. A prefabricated wall panel according to any one of claims 1, 2 or 3 in which the outer surfaces of said inner tongues have serrations thereon in engagement with the inner surface of the free edges of said facing sheets of an adjacent panel.

5. A prefabricated wall panel according to any one of claims 1, 2 or 3 in which said connecting member 15 has a lip along each side thereof extending inwardly along its adjacent facing sheet, and in which each of said lips is in sealing contact with the inner surface of its adjacent facing sheet.

6. A prefabricated wall panel according to any one of claims 1, 2 or 3 in which when two such panels are assembled space is provided between the inner and outer laterally projecting tongues.

* * * * *